US007727338B2

(12) United States Patent
Kaczmarek

(10) Patent No.: US 7,727,338 B2
(45) Date of Patent: Jun. 1, 2010

(54) DISHWASHER MACHINE WITH DOOR AND HANDLE ELEMENT

(75) Inventor: Wolfgang Kaczmarek, Schwindegg (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 542 days.

(21) Appl. No.: 11/640,518

(22) Filed: Dec. 15, 2006

(65) Prior Publication Data

US 2007/0144566 A1 Jun. 28, 2007

(30) Foreign Application Priority Data

Dec. 23, 2005 (DE) ..... 10 2005 061 803

(51) Int. Cl.
*B08B 3/00* (2006.01)

(52) U.S. Cl. ..... 134/56 D; 134/57 D

(58) Field of Classification Search ..... 134/57 D
See application file for complete search history.

(56) References Cited

U.S. PATENT DOCUMENTS 3,684,343 A 8/1972 Hancock
3,841,675 A * 10/1974 Mercer ..... 292/241
3,870,136 A * 3/1975 Voegeli ..... 194/247
5,810,403 A * 9/1998 Prada ..... 292/128

FOREIGN PATENT DOCUMENTS

| | | |
|---|---|---|
| DE | 23 64 647 | 6/1975 |
| DE | 84 16 860 | 11/1984 |
| DE | 199 07 233 | 8/2000 |
| DE | 100 56 985 | 6/2002 |
| EP | 1 321 092 | 6/2003 |

OTHER PUBLICATIONS

Schembera, Friedrich, Jun. 1975, DE2364647A1, English machine translation.*

* cited by examiner

*Primary Examiner*—Michael Barr
*Assistant Examiner*—Jason Y Ko
(74) *Attorney, Agent, or Firm*—James E. Howard; Andre Pallapies

(57) ABSTRACT

A hinged door for a dishwashing machine comprising a handle element for unlocking and actuating the door, the handle element being arranged on an upper side of the door.

24 Claims, 3 Drawing Sheets

DISHWASHER MACHINE WITH DOOR AND HANDLE ELEMENT

Figure 1:
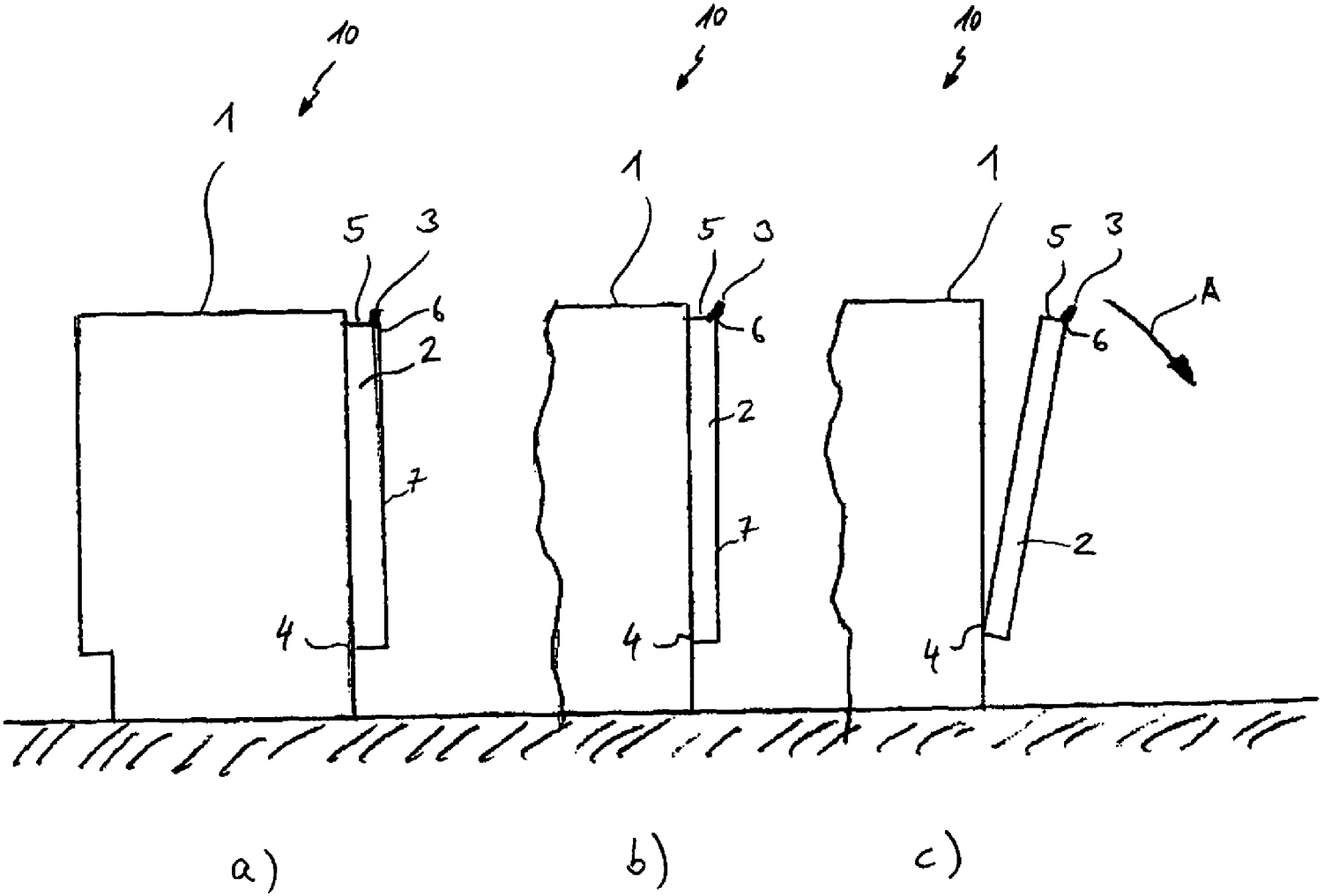

The invention relates to a dishwasher machine, in particular a domestic dishwasher machine, comprising a door which can pivot about a horizontal axis for opening and closing a washing container, comprising a handle element for actuating the door and a lock for locking and unlocking the door.

Known from DE 84 16 860 U1 is a dishwasher machine door provided with a fold-in support which supports the door on the floor in the folded-out state. When the door is closed, the fold-in support is recessed flush into the door plane of the door, thereby avoiding protruding parts and not disadvantageously altering the appearance of the front surface of the door. The support serves at the same time as a closing and opening lever for the door. For simplified operation, a handle recess can be provided for this purpose in the door. A disadvantage with this arrangement is the complex manufacture of the door, in particular the outer surface, since indentations adapted to the support and a handle recess must be provided.

Further known from DE 23 64 647 A1 is a baking oven door for cookers in which the door handle is disposed in such a manner that it can be pulled out or pivoted out on the baking oven door. A recessed door handle is provided for this purpose which makes it possible to have a flat door without protruding parts. The arrangement cannot easily be transferred to doors of a dishwasher machine, for example, since a mechanism for locking and unlocking the door to the housing must be provided for sealing reasons. Such a locking or unlocking mechanism should appropriately be operatively connected to the handle so that a separate unlocking can be dispensed with.

It is the object of the invention to provide a door for a dishwasher machine which has no protruding parts and which can easily be operated when using the door.

The object is achieved with a dishwasher machine having the features according to claim 1. Advantageous embodiments are obtained in each case from the dependent claims.

The dishwasher machine according to the invention is fitted with a door in the following manner. According to the invention, it is provided that a handle element for unlocking and actuating the door is disposed ion the upper side of the door, said upper side being horizontally aligned when the door is closed. This makes it possible to construct a completely flat surface of the door with no protruding elements whose visual appearance is not impaired by any control element. In addition to the improved visual impression, a production technology advantage is also obtained since the externally visible door surface need not be subjected to any deformation steps or other processing steps. For example, the panels usually required in the area of the handle element and actuating elements provided there can be dispensed with.

The handle element is preferably operatively connected to the lock for locking and unlocking the door. In a further embodiment, the lock can be unlocked by pulling on the handle element when opening the door.

The arrangement of the handle element according to the invention on the upper side of the door has the further advantage that an easy-to-operate bow-type handle can be used which is embodied as a handle which can be tilted about an axis of rotation. In this case, the handle can extend over the entire width of the door or only over a part of the width of the door. The arrangement of the handle element according to the invention is preferably combined with an arrangement of the operating and display elements likewise in the area of the upper side of the door.

In a further development of the invention, in the locked state of the door the handle element is arranged in a locking position parallel to a plane of a door surface. This has the advantage that the handle element is easy to operate for the user of the dishwasher machine. In particular, it is conveniently possible for the user to unlock the door and open it by tilting.

In a further development it is provided that in the unlocked state of the door the handle element can engage in a tilt position in which the door can be opened by tilting with respect to the housing of the dishwasher machine. In the tilt position, the handle element is arranged so that it is tilted, e.g. sloping towards the front, with respect to the locking position. This has the advantage that the door can be also be ajar to the housing of the dishwasher machine when unlocked so that the force for opening the door is reduced. By engaging the handle element in a tilt position, it is also easily identifiable for the user whether the door of the dishwasher machine is in a locked or in an unlocked state.

In another embodiment it is provided that for unlocking the door the handle element can be brought into a tilt position in which the door can be opened by tilting with respect to a housing of the dishwasher machine, wherein a spring element brings the handle element into its initial position after the unlocking. In this case, the initial position can be a position, as in the locked state of the door, parallel to a plane of the door surface, wherein the door is not locked however. As a result, the image of the door of the dishwasher machine is visually always the same for the user regardless of whether this is locked or unlocked. This also ensures that no parts protruding beyond the door exist at any time.

The mechanism for locking and unlocking the door can in principle be embodied in any manner. According to an advantageous embodiment, it is provided that the handle element is operatively connected to a snap lock for locking and unlocking the door. Such a snap lock is described, for example, in DE 100 56 985 A1 of the applicant, the contents whereof being included in this application.

According to one embodiment, the dishwasher machine is embodied as a free-standing device with a cover plate, wherein the cover plate is set back with respect to the door surface at least in the region of the handle element.

Alternatively or additionally, it can be provided that the cover plate of the dishwasher machine embodied as a free-standing device is provided with a recess directed towards the handle element on its underside, thus also simplifying the operation of the handle element. In this case, the width of the recess is matched to the width of the handle element and can extend in the most extreme case almost over the entire width of the cover plate of the dishwasher machine.

Figure 2:
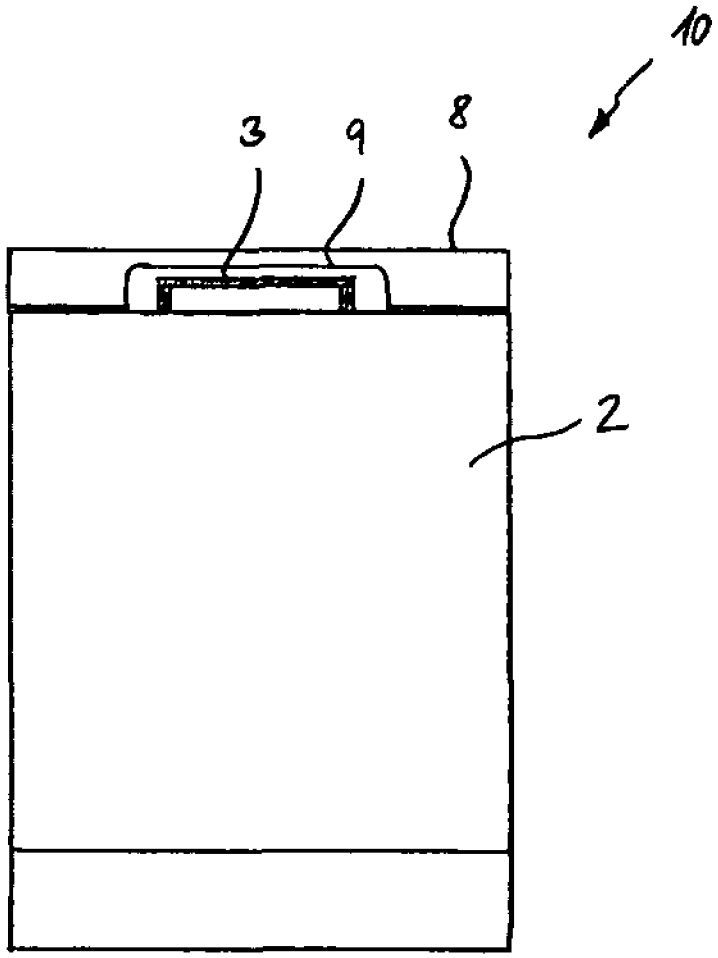
Figure 3:
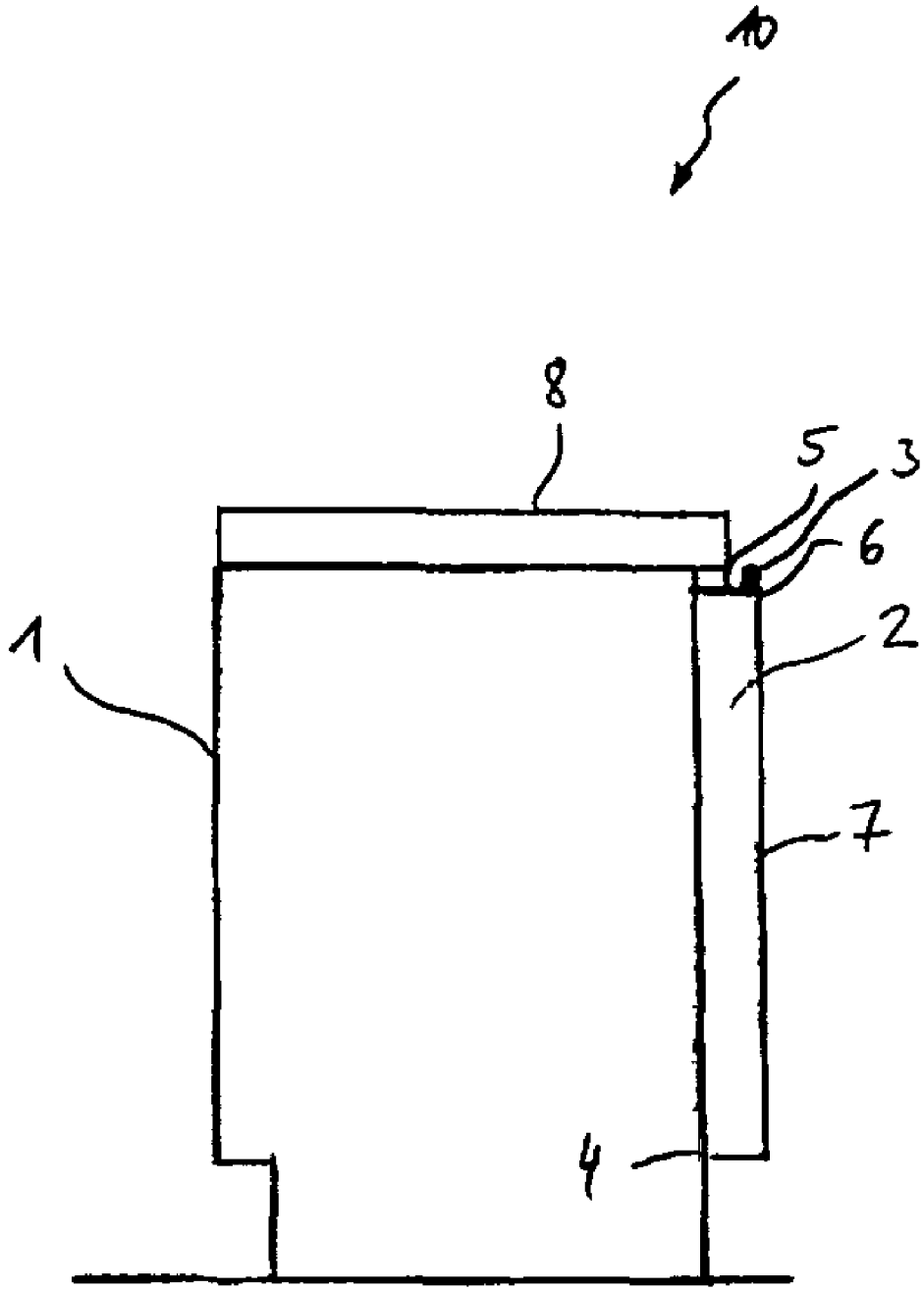

The invention and its advantages are described in detail hereinafter with reference to the appended figures. In the figures:

FIG. 1-1*c* is a side view of a dishwasher machine according to the invention in the closed and locked state, in the closed and unlocked state and in the open state, FIG. 2 is a front view of a dishwasher machine designed as a free-standing device with a cover plate provided with a handle recess and FIG. 3 is a side view of a dishwasher machine embodied as a free-standing device with a cover plate set back with respect to the handle element.

FIG. 1 is sectional view of a dishwasher machine 10 according to the invention, comprising a door 2 which is secured to a door hinge 4 arranged on the underside of a housing 1 for tiltable opening. On its upper side 5 the door 2 has a handle element 3 which is disposed close to a door surface 7 in the front section of the upper side 5 and can be tilted about an axis of rotation 6 for unlocking the door 2.

FIG. 1*a* shows the dishwasher machine 10 in a closed state, wherein the handle element 3 is arranged parallel to the plane of the door surface 7 in which the door 2 is locked in operative connection with the housing 1. The plane of the door surface 7 extends perpendicularly from the plane of the drawing. FIG. 1*b* further shows the closed dishwasher machine 10, where the handle element 3 is located in a tilt position, however, so that it slopes towards the front, i.e. towards the user, in which the unlocking mechanism (not shown) is unlocked so that the door can be opened simply by tilting with respect to the housing 1 of the dishwasher machine 10. Tilting the door is effected by further pulling on the handle element 3. This is shown in FIG. 1*c*, wherein the pulling on the handle element 3 is indicated by the arrow A.

The advantage of the arrangement of the handle element 3 on the upper side 5 of the door 2 is that the door surface 7 can be manufactured as completely smooth without any profiling or stampings, as is shown in FIG. 2 for example. The upper side 5 of the door 2 is understood as the upper roof wall of the door 2 in a position in FIG. 1 *a*). If the control and display elements for switching on and off or programming the dishwasher machine 10 are likewise arranged on the upper side 5, the otherwise usual trim in the area of the door surface 7 can be completely dispensed with, resulting in a visually particularly advantageous image.

FIG. 2 shows an exemplary embodiment of the dishwasher machine 10 as a free-standing device which has a cover plate 8 on the upper side of the housing 1. In order to make operation of the handle element 3 as simple as possible for the user, a handle recess 9 is provided in the front region of the cover plate 8. The width of the handle element 3 and the width of the handle recess 9 are matched to one another.

In another exemplary embodiment, unlike that shown in the drawings, the handle can also run over the entire width of the dishwasher machine or the door 2. The handle recess 9 would then be correspondingly matched to this width.

Whereas in the exemplary embodiment in FIG. 2, the cover plate 8 can end in the plane of the door surface 7, in the exemplary embodiment according to FIG. 3, the cover plate 8 is set back with respect to the door surface 7 so that the handle element can be operated from the from and the top.

The mechanism for locking and unlocking the door 2 of the dishwasher machine 10 can in principle be arbitrarily constructed and is preferably formed as a snap lock operatively connected to the handle element 3. In an unlocked position, the handle element 3 can be engaged in a tilt position as shown in FIG. 1*b*, for example, so that the user can immediately identify whether the door is locked or unlocked. In this case, a defined resistance is obtained when pulling on the handle element to open the door.

In another embodiment, the handle element can tilt back into its initial position after unlocking as a result of a spring element so that the position shown in FIG. 1*a* is attained visually. For opening the door the user can likewise pull on the handle element 3, whereby this will initially reach the position shown in FIG. 1*b* as a result of its spring mounting before the door is tilted as shown in FIG. 1*c*.

REFERENCE LIST

1 Housing
2 Door
3 Handle element
4 Door hinge
5 Upper side
6 Axis of rotation
7 Door surface
8 Cover plate
9 Handle recess
10 Dishwasher machine
A Direction of opening

The invention claimed is:

1. A dishwashing machine comprising:
a washing container having an access opening;
a device for washing crockery disposed within the washing container;
a door tiltable about a horizontal axis between an open position in which access to the washing container via the access opening of the washing container can be had for disposing crockery within the washing container and a closed position in which access to the washing container via the access opening of the washing container for disposing crockery within the washing container can no longer be had, the door having an upper edge with an upper side positioned adjacent the upper edge, the upper side defining an upper roof wall of the door;
a lock for locking and unlocking the door; and
a handle element for actuating the door, the handle element being located on the upper roof wall of the door and the upper roof wall of the door being substantially horizontally aligned when the door is in its closed position.

2. The dishwasher machine according to claim 1, wherein the handle element is operatively connected to the lock for locking and unlocking the door.

3. The dishwasher machine according to claim 2, wherein the lock can be unlocked by pulling on the handle element when opening the door.

4. The dishwasher machine according to claim 2, wherein the handle element is configured as a handle tiltable about an axis of rotation.

5. The dishwasher machine according to claim 2, wherein, in the locked state of the door, the handle element is arranged in a locking position parallel to a plane of a door surface.

6. The dishwasher machine according to claim 2, wherein, in the unlocked state of the door, the handle element can engage in a tilt position in which the door can be opened by tilting with respect to the housing of the dishwasher machine.

7. The dishwasher machine according to claim 2, wherein, for unlocking the door, the handle element can be brought into a tilt position in which the door can be opened by tilting with respect to a housing of the dishwasher machine, wherein a spring element brings the handle element into its initial position after the unlocking.

8. The dishwasher machine according to claim 2, wherein the handle element is operatively connected to a snap lock for locking and unlocking the door.

9. The dishwasher machine according to claim 2, wherein the dishwasher machine is configured as a free-standing device with a cover plate, wherein the cover plate is set back with respect to a front door surface of the door at least in the region of the handle element.

10. The dishwasher machine according to claim 2, wherein the dishwasher machine is configured as a free-standing device with a cover plate, wherein the cover plate is provided with a handle recess directed towards the handle element on its underside.

11. The dishwasher machine according to claim 1, wherein the door defines a front door surface that is completely smooth without any profiling or stampings.

12. A dishwashing machine comprising:
a washing container having an access opening;
a device to wash crockery disposed within the washing container;

a door tiltable about a horizontal axis between an open position in which crockery can be disposed within the washing container and a closed position in which access to the washing container via the access opening of the washing container is prevented, the door having a front door surface defining an edge with a perimeter, the front door surface being completely planar without any profiling or stampings;

a lock for locking and unlocking the door; and a handle element to actuate the door, the handle element being located on the door without compromising the completely planar condition of the front door surface.

13. The dishwasher machine according to claim 12, wherein the handle element is operatively connected to the lock to lock and unlock the door.

14. The dishwasher machine according to claim 12, wherein the lock can be unlocked by pulling on the handle element when opening the door.

15. The dishwasher machine according to claim 12, wherein the handle element is configured as a handle tiltable about an axis of rotation.

16. The dishwasher machine according to claim 12, wherein, in the locked state of the door, the handle element is arranged in a locking position parallel to a plane of a door surface.

17. The dishwasher machine according to claim 13, wherein, in the unlocked state of the door, the handle element is positioned in a tilt position in which the door can be opened by tilting with respect to the housing of the dishwasher machine.

18. The dishwasher machine according to claim 12, wherein, to unlock the door, the handle element can be brought into a tilt position in which the door can be opened by tilting with respect to a housing of the dishwasher machine, wherein a spring element brings the handle element into its initial position after the unlocking.

19. The dishwasher machine according to claim 12, wherein the handle element is operatively connected to a snap lock to lock and unlock the door.

20. The dishwasher machine according to claim 12, wherein the dishwasher machine is configured as a free-standing device with a cover plate, wherein the cover plate is set back with respect to the front door surface at least in the region of the handle element.

21. The dishwasher machine according to claim 12, wherein the dishwasher machine is configured as a free-standing device with a cover plate, wherein the cover plate is provided with a handle recess directed towards the handle element on its underside.

22. The dishwasher machine according to claim 12, wherein the handle element is provided outside the perimeter of the front door surface.

23. The dishwasher machine according to claim 22, wherein the handle element is provided on an upper roof wall of the door, the upper roof wall and the front door surface intersecting at the edge.

24. The dishwasher machine according to claim 12, wherein the handle is tiltable about an axis running along the edge of the handle in a locked position in which the handle is substantially parallel to the front door surface and an unlocked position in which the handle is not parallel to the front door surface.

* * * * *